United States Patent [19]

Becker

[11] Patent Number: 4,486,051

[45] Date of Patent: Dec. 4, 1984

[54] MINING MACHINE

[75] Inventor: Harry R. Becker, Utica, Pa.

[73] Assignee: Joy Manufacturing Company, Pittsburgh, Pa.

[21] Appl. No.: 442,988

[22] Filed: Nov. 19, 1982

[51] Int. Cl.[3] ..... E21C 25/06

[52] U.S. Cl. ..... 299/78; 299/65; 74/425

[58] Field of Search ..... 299/78, 76, 89; 74/665 C, 425; 175/319, 338, 106, 89

[56] References Cited

U.S. PATENT DOCUMENTS

| | | | |
|---|---|---|---|
| 557,340 | 3/1896 | Palmer | 299/45 |
| 1,477,563 | 12/1923 | Hirschfield | 175/106 |
| 1,702,571 | 2/1929 | Pratt | 299/52 |
| 2,619,339 | 11/1952 | Cartlidge | 299/64 |
| 3,091,440 | 5/1963 | Gillespie | 299/43 |
| 3,695,725 | 10/1972 | Pendolino | 299/80 |
| 3,773,384 | 11/1973 | Anderson | 299/76 |
| 3,804,466 | 4/1974 | Cilles | 299/78 |
| 4,225,189 | 9/1980 | LeBegue | 299/71 |

*Primary Examiner*—Stephen J. Novosad
*Assistant Examiner*—Mark J. DelSignore
*Attorney, Agent, or Firm*—Raymond W. Augustin

[57] ABSTRACT

A mining machine is disclosed comprising a mobile base and a cutting head assembly at a forward end of the mobile base having a cutter drum rotatable about an output shaft disposed along the longitudinal axis of the cutter drum. A drive system for the cutting head assembly comprises at least one motor for driving at least one toothed motor pinion and a generally cylindrical combination gear having generally circular end surfaces. A bevel or face gear is formed in at least one of the end surfaces, having teeth adapted to mate with and be driven by the toothed motor pinion. The combination gear has a worm gear formed in the outside cylindrical surface, which is disposed in driving engagement with the teeth of an output gear integrally and coaxially connected to the output shaft of the cutter drum.

9 Claims, 3 Drawing Figures

MINING MACHINE

BRIEF SUMMARY OF THE INVENTION

The present invention relates to a cutter head gear arrangement and more particularly to a gearcase for transmitting motion to a rotating drum such as the cutter drum or cutter head of a continuous mining machine.

A current gear arrangement for a cutter head drive system for a continuous miner includes two motors, one on each side and both located internally of the cutter head. In this internal arrangement, each motor has a pinion which transmits motion to the main shaft of a cutter head through a series of planetary gears and cages which typically number ten (10) gears on each side of the cutter head drive system, or a total of twenty (20) gears for each cutter head drive system. More complete descriptions of continuous mining machines having a rotary cutter drum with internal drive motors and gear systems are found in U.S. Pat. Nos. 3,695,725, 3,773,384 and 4,047,763 which are incorporated herein by reference.

Another common external gear arrangement for a cutter head drive system includes a pair of motors disposed rearwardly of the cutter head. Suitable gear trains are employed to transmit the drive from the respectibve motors through a series of intermediate gears to final gears. The final gears are typically in driving engagement with a splined portion of the output shaft on which the cutter head rotates. This type of gear arrangement typically employs sixteen (16) total gears, with eight (8) gears on each side of the drive system. Such a gear arrangement is disclosed in U.S. Pat. Nos. 3,614,162, 3,695,725, 3,697,136 and 3,773,384 which are also incorporated herein by reference.

Although current gear arrangements for cutter head drive systems perform adequately, it may be desirable in some instances to simplify the gear arrangement by, for example, reducing the total number of gears in the system. Typically, a reduction in the number of gears in a gear train results in increased reliability in the associated equipment, reduced maintenance requirements, and decreased capital cost. Also, it is always desirable to provide gear arrangements which increase mounting flexibility for the drive motors and for the cutter head.

Accordingly, a new and improved gear arrangement for a cutter head drive system for a mining machine is desired which consists of a minimum number of gears. Additionally, a new and improved combination gear, specifically a combination face gear and miter worm gear or a combination bevel gear and miter worm gear is desired for use in a cutter head drive system.

The present invention may be summarized as providing a mining machine comprising a mobile base and a cutting head assembly at a forward end of the mobile base, having a cutter drum rotatable about an output shaft disposed along the longitudinal axis of the cutter drum. A drive system for the cutting head assembly comprises at least one motor for driving at least one toothed motor pinion and a generally cylindrical combination gear having generally circular end surfaces. A bevel gear or face gear is formed in at least one of the end surfaces, having teeth adapted to mate with and be driven by the toothed motor pinion. The combination gear has a worm gear formed in the outer cylindrical surface, which is disposed in driving engagement with the teeth of an output gear integrally and coaxially connected to the output shaft of the cutter drum.

An objective of the present invention is to provide a mining machine having an improved cutter head gear system.

An advantage of the improved cutter head gear system of the present invention is a reduction in the number of gears employed.

A further objective of this invention is a simplification of the gear system of a continuous mining machine which provides increased flexibility in mounting of the cutter drums and the drive motors for the gear system.

Another possible advantage of this invention is a reduction in the noise level generated by the operation of the gear system of a continous mining machine.

These and other objectives and advantages of this invention will be more fully understood and appreciated with reference to the following description and the drawings appended hereto.

DETAILED DESCRIPTION

Figure 1:
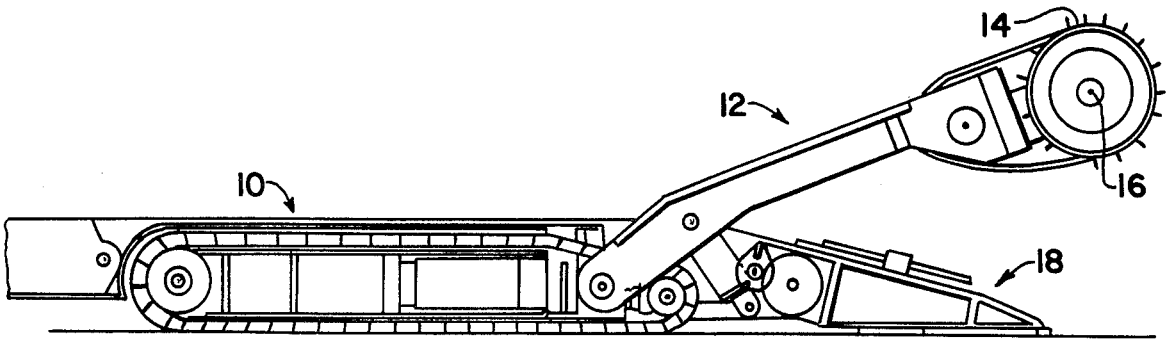
FIG. 1 is a side elevation view of a mining machine having a cutting head assembly at a forward end thereof.

Referring particularly to the drawings, FIG. 1 shows a mining machine in which the present invention may be employed. The mining machine shown in FIG. 1 has a mobile base 10. The machine is typically provided with crawler tracks, but wheels or other mechanisms may be used to propel the mining machine. A cutting head assembly 12 is located at a forward end of the base 10. The assembly 12 includes a cutter drum 14 rotatable about an output shaft 16. The output shaft 16 is disposed along the longitudinal axis of the cutter drum 14. An exemplary machines in which the present invention may be adapted include the 14 CM and 15 CM continuous mining machines manufactured and sold by Joy Manufacturing Company, although many other mining and cutting machines are also applicable.

In operation, the cutter drum 14 which is provided with cutting tools, such as conventional cutter bits and blocks, is driven into a mine seam. The rotation and the upward and downward movement of the cutter drum cuts and breaks the material at the mine face. As is also conventional, a gathering head 18 may be provided below the cutter drum to collect the mined material and deliver such material to the rear of the machine. At the rear of the machine the material may be removed by a haulage vehicle, a conveyor or other material transfer equipment.

Figure 2:
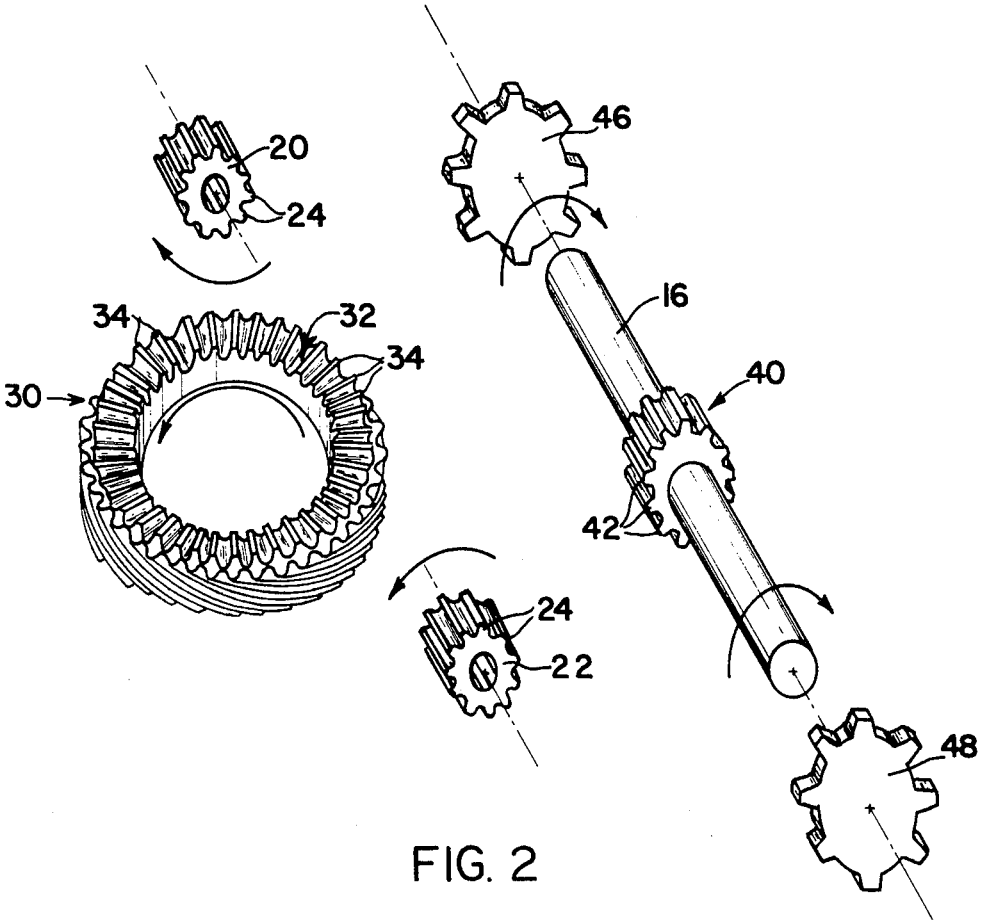
FIG. 2 is a partial exploded perspective view of a gear arrangement for a cutting head assembly of a mining machine.
Figure 3:
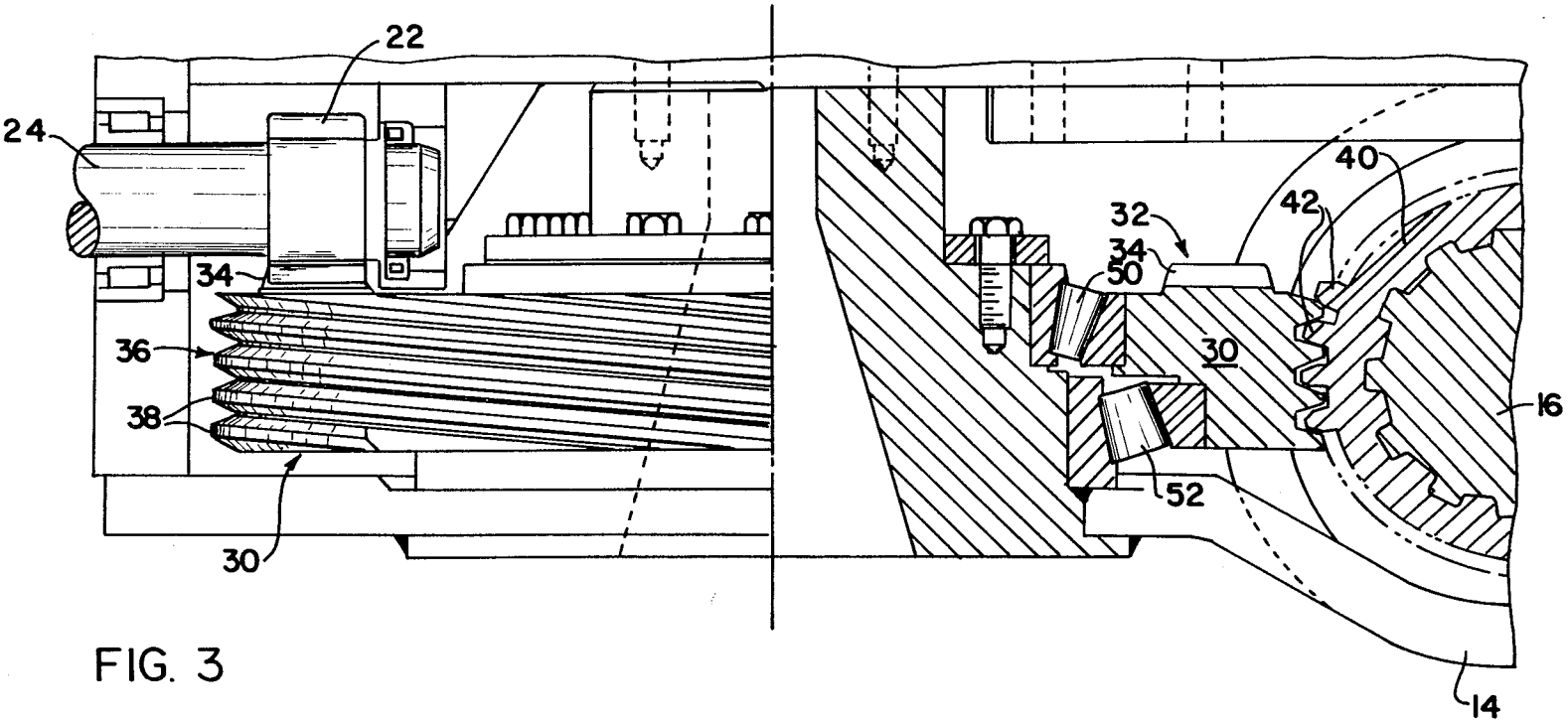
FIG. 3 is a side elevation view partially in cross section of a gear arrangement for a cutting head assembly of a mining machine.

The cutter drum 14 on the mining machine of the present invention is rotated by a gear assembly, a preferred embodiment of which is illustrated in FIGS. 2 and 3. Basically, the gear assembly includes at least one, and preferably two motors with one motor disposed on each side of the cutter head assembly 12 near the cutter drum 14.

Motor pinions 20 and 22 are integrally attached to the output shaft 24 of the respective motors. In a preferred embodiment, one pinion 20 is adapted to be driven or rotated in the clockwise direction as the other pinion 22 is driven or rotated in a counterclockwise direction as shown in FIG. 2. The operation of multiple motor pinions should be synchronized such that the pinions engage the combination gear simultaneously and operate at the same rate. The motor pinion assemblies may be disposed about the combination gear 30 at any convenient angle. In a preferred embodiment the motor pinion consists of hard carburized steel, has straight, spur type teeth with a preferred diametrical pitch of 2½. This type of pinion can be made easily with no bearing thrusts. With eleven teeth, the diameter of the pitch circle on the preferred pinions would be about 4.4 inches. Of course, alternative embodiments and dimensions could be employed for the pinions 20 and 22 of the present invention.

The gear assembly of the present invention includes a combination gear 30 which preferably lies in the horizontal plane with respect to the cutter head assembly 12. The horizontal disposition permits the use of a combination gear of relatively large diameter, i.e. greater than twelve inches. The combination gear has a generally cylindrical configuration, and in a preferred embodiment has a hollow central portion. The end faces of the combination gear 30 are generally circular, with a bevel gear 32 formed in at least one of the end surfaces. The bevel gear 32 is preferably provided with straight teeth 34; however, coniflex straight teeth, spiral teeth or other configurations may be used provided that the bevel gear teeth 34 are adapted to mate with and be driven by the teeth 24 of the motor pinion. Use of bevel gears required careful adjustment of the bevels. In a preferred embodiment the bevel gear 32 portion of the combination gear 30 has forty-one (41) teeth having a diametrical pitch of 2½, matching the diametrical pitch of the motor pinion. It should be noted that face gears, such as those having teeth at 90° to the gear plane can be used in place of the bevel gears.

The combination gear 30 also includes a worm gear 36 formed in the outer cylindrical surface thereof. The motor pinions 20 and 22 which drive the bevel gear 32, simultaneously drive the worm gear 36 in direct response thereto. In other words, the rotation rate of the bevel gear 32 and the worm gear 36 expressed in terms of rotations per minute (RPM) are equal. As best shown in FIG. 3, a preferred worm gear 36 is provided with four leads 38. A preferred worm gear 36 has a pitch diameter of 17⅝ inches. The pitch diameter of the worm gear 36 is established by the number of teeth, which in turn is determined by the gear ratio that is desired. In a preferred embodiment, a gear reduction of at least a factor of five is achieved through the worm gear 36 to the output gear 40, expressed in terms of rotations per minute (RPM).

Although it is preferred that the combination gear be formed as a single unit, such as upset forging and machining a single pierced ring of carburized steel, the combination gear 30 may consist of multiple sections arranged and disposed such that the bevel gear 32 and the worm gear 36 rotate simultaneously in direct response to the motor pinion drive. Ideally, the metallurgy of the combination gear is the same as that of the motor pinions, however, dissimilar alloys of adequate strength may be compatible for the pinions and the combination gear.

An output gear 40 is integrally and coaxially connected to the output shaft 16 of the cutting drum 41 which is attached to the shaft 16 through suitable anti-friction bearings. The teeth of the worm gear 36 are disposed in driving engagement with the teeth 42 of the output gear 40. More particularly, the axis of rotation of the worm gear 36 is preferably disposed at a 90° angle to the axis of rotation of the output gear 40. As is understandable, a large speed reduction is obtained in transmitting motion through the worm gear 36 of this invention.

In a preferred embodiment the number of teeth 42 on the output gear 40 is a multiple of the number of teeth 38 on the worm gear 36. This arrangement permits break-in and full loading to be achieved earlier than if such arrangement is not provided. In a preferred embodiment the worm gear 36 is provided with four (4) leads 38, and the output gear 40 has twenty-four (24) teeth 42. It has also been found that the helix angle on the leads 38 of the worm gear 36 can be varied with the number of teeth 42 on the output gear 40 to alter the gear reduction ratio. In a preferred embodiment an eight (8) inch wide output gear with three (3) of twenty four (24) total teeth 42 in constant engagement with the worm leads 36, provides adequate load distribution in the gear system of the present invention. The output gear 40 should accommodate significant sliding action as is experienced in operation of the intermeshing worm gear 36; and, therefore the output gear 40 should be readily changeable by sliding from the output shaft 16.

As shown in the preferred embodiment of FIG. 3, tapered roller bearings 50 and 52 may be provided for the combination gear 30. A thrust bearing may also be provided in addition to the tapered roller bearings. The output gear 40 should be hung on the output shaft 16 with bearings capable of withstanding not only rotation but also a suitable degree of thrust due to the force provided by intermeshing with the worm gear 36 having driving teeth 38 disposed at a preferred helix angle of about five to six and one-half degrees (5°–6½°). Double angular contact ball bearings have been found capable of resisting such thrust as well as the separating and driving forces generated in the operation of the mining machine of this invention.

In a preferred embodiment a pair, or more, of sprockets 46 and 48 are attached to either the output shaft 16 or the cutter drum 14, and are driven in conjunction with the output shaft 16. Such sprockets are used to drive cutter chains, such as the well known RIPPER-VEYOR cutter chains manufactured by Joy Manufacturing Company. Preferably, the outside orbit of the cutter chains is substantially coincident with the outside diameter of the cutter drum 14 such that all of the cutting tools in the cutter assembly are driven in unison to cut along a generally planar face in a mine. It will be understood by those skilled in the art that the gear system of the present invention permits the use of larger than standard bearings throughout the system. It will also be appreciated that the mounting and assembly for the cutter drum may be simplified by the present invention.

An alloy preferred for the pinion and gears of the present invention is SAE 8620-9310 carburizing grade steel, carburized to a depth of from 65 to 100 mil, with a Rockwell hardness ($R_c$) of about 57–63. It will be appreciated by those skilled in the art that various materials and specifications may be employed for the gear assembly of the present invention. Additionally, various gear pitch, pressure angle, tooth profile and size may be employed in the gear assembly of this invention.

To operate the mining machine 10 of the present invention, the machine is advanced to a location where mining shall commence. The cutting head assembly 12 is activated by engaging the motors by appropriate electronic circuitry. In a preferred embodiment the output shaft 24 of the motor and the pinions 20 and 22 attached thereto, are rotated at a rate of about 1200 RPM. The pinions 20 and 22 are simultaneously brought into mesh with the teeth 34 of the bevel gear 32 to drive the bevel gear 32 at a rate of about 314 RPM. The worm gear 36 integral with the bevel gear 32, likewise driven at 314 RPM, drives the output gear 40, the output shaft 16, the sprockets 46 and 48, and the drum 14 at a reduced rate of about 52.6 RPM. It should be noted that the preferred direction of the rotation for the pinions, combination gear, and the output gear and shaft are as shown in FIG. 2.

With the cutter head 14 and cutting chains rotating, the cutting head assembly 12 is raised toward the mine roof. After such initial upward pivoting of the assembly 12, the cutter head is driven inwardly to begin a cut in the mine face, and downwardly to the mine floor to complete a cut of the mine face. As mentioned above, it is important that the cut material be conveyed rearwardly during the cutting operation such as with a conventional gathering head 18 and material transport equipment. After each cut, the machine is repositioned to repeat the cutting operation on the mine face.

Whereas the preferred embodiments of the present invention have been described above for the purposes of illustration, it will be apparent to those skilled in the art that numerous variations of the details may be made without departing from the invention.

I claim:

1. A mining machine comprising:

a mobile base, a cutting head assembly at a forward end of said mobile base, having a cutter drum rotatable about an output shaft disposed along the longitudinal axis of the cutter drum, means for driving the cutter drum comprising:

at least one motor for driving at lease one toothed motor pinion, a generally cylindrical combination gear having generally circular end surfaces, a second gear selected from the group consisting of a bevel gear and a face gear, formed in at least one of the end surfaces having teeth adapted to mate with and be driven by the at least one toothed motor pinion, a worm gear formed in the outer cylindrical surface of the combination gear and disposed in driving engagement with the teeth of an output gear integrally and coaxially connected to the output shaft of the cutting drum.

2. A mining machine as set forth in claim 1 further including at least one sprocket integrally and coaxially connected to the output shaft over which a cutter chain is driven in the direction that the cutter drum is rotated.

3. A mining machine as set forth in claim 2 wherein two sprockets, one disposed on each side of the output gear, are provided.

4. A mining machine as set forth in claim 1 wherein at least two motors, and at least two synchronized motor pinions are provided for driving the cutter drum.

5. A mining machine as set forth in claim 1 wherein the number of teeth of the output gear is a multiple of the number of teeth on the worm gear.

6. A mining machine as set forth in claim 1 wherein the worm gear has teeth disposed at a helix angle of greater than 3 degrees.

7. A mining machine as set forth in claim 1 wherein the worm gear has teeth disposed at a helix angle of from 5 to 6½ degrees.

8. A mining machine as set forth in claim 1 wherein a gear reduction is at least a factor of three is achieved through the worm gear, in terms of rotations per minute.

9. A mining machine as set forth in claim 1 wherein a gear reduction of at least a factor of five is achieved through the worm gear, in terms of rotations per minute.

* * * * *